US007150463B1

(12) United States Patent
Liao

(10) Patent No.: US 7,150,463 B1
(45) Date of Patent: Dec. 19, 2006

(54) WHEELCHAIR CAPABLE OF ABSORBING ROAD SHOCK

(75) Inventor: Feng-Huei Liao, Chia Yi (TW)

(73) Assignee: Sunpex Technology Co., Ltd., Chia Yi (TW)

( * ) Notice: Subject to any disclaimer, the term of this patent is extended or adjusted under 35 U.S.C. 154(b) by 0 days.

(21) Appl. No.: 11/228,570

(22) Filed: Sep. 15, 2005

(51) Int. Cl.
*A61G 5/04* (2006.01)
*A61G 5/10* (2006.01)

(52) U.S. Cl. ..... 280/124.128; 180/65.1; 180/907; 280/304.1; 280/124.11; 280/124.116; 280/DIG. 10

(58) Field of Classification Search ..... 280/124.116, 280/124.128, 124.11, 124.1, 250.1, 304.1, 280/DIG. 10; 180/65.1, 907
See application file for complete search history.

(56) References Cited

U.S. PATENT DOCUMENTS 6,206,119 B1 * 3/2001 Wu ..... 180/65.1
6,234,507 B1 * 5/2001 Dickie et al. ..... 280/304.1
6,460,641 B1 * 10/2002 Kral ..... 180/24.02
6,494,474 B1 * 12/2002 Kramer, Jr. ..... 280/304.1
6,752,230 B1 * 6/2004 Huang ..... 180/209
6,845,996 B1 * 1/2005 Cheng ..... 280/124.179
6,923,278 B1 * 8/2005 Mulhern et al. ..... 180/65.1
6,935,448 B1 * 8/2005 Goertzen et al. ..... 180/65.1
6,938,923 B1 * 9/2005 Mulhern et al. ..... 280/755
7,021,641 B1 * 4/2006 Wu ..... 280/250.1
7,055,835 B1 * 6/2006 Wu ..... 280/86.1
7,104,346 B1 * 9/2006 Schaffner ..... 180/65.1
2006/0201723 A1 * 9/2006 Hsu et al. ..... 180/24.02

* cited by examiner

*Primary Examiner*—Ruth Ilan
(74) *Attorney, Agent, or Firm*—Merchant & Gould P.C.

(57) ABSTRACT

A wheelchair includes a chair frame, two suspension arms, two clutches, two drive wheels, two shock absorbers, and two limiting units. The chair frame includes two lateral frame parts. Each of the suspension arms is connected pivotally to the chair frame adjacent to a respective lateral frame part. Each of the clutches is mounted on a respective suspension arm. Each of the drive wheels is coupled to a respective clutch. Each of the shock absorbers is mounted between a respective lateral frame part and a respective suspension arm. Each of the limiting units includes a mounting seat mounted on a respective lateral frame part and formed with a guide slot unit therethrough, and a connecting component that extends through the guide slot unit and that mounts movably a respective suspension arm on the mounting seat.

11 Claims, 5 Drawing Sheets

WHEELCHAIR CAPABLE OF ABSORBING ROAD SHOCK

BACKGROUND OF THE INVENTION

1. Field of the Invention

The invention relates to a wheelchair, more particularly to a wheelchair that is capable of absorbing road shock.

2. Description of the Related Art

Power wheelchairs have become a mode of transport for the handicapped and the elderly. A power wheelchair usually has a pair of drive wheels mounted on opposite lateral sides of a chair frame, and two front wheels and two rear wheels mounted in front and behind the drive wheels, respectively. A drive device is mounted on the chair frame for driving the drive wheels. The power wheelchair is also provided with a set of shock absorbers for absorbing road shock so as to enhance user comfort.

Referring to FIGS. 1 and 2, a conventional power wheelchair 1 is shown to include a chair frame 11 mounted with a drive device (not shown). The chair frame 11 includes an intermediate frame part 111 and a pair of lateral frame parts 112 fixed to opposite ends of the intermediate frame part 111, respectively.

Each of a pair of suspension arms 131 is connected pivotally to a bottom side of the intermediate frame part 111 through a respective pivot axle 130, and is disposed below a respective one of the lateral frame parts 112. Each of a pair of clutches 132 is mounted fixedly on a respective one of the suspension arms 131. Each of a pair of drive wheels 133 is coupled to a respective one of the clutches 132. Each of a pair of shock absorbers 134 is mounted between a respective one of the lateral frame parts 112 and a respective one of the suspension arms 131, and is capable of absorbing road shock forces.

When the drive wheels 133 of the power wheelchair 1 move on an uneven road, because the drive wheels 133 are connected to the suspension arms 131 through the clutches 132, the suspension arms 131 are able to pivot accordingly about the pivot axles 130, and the shock absorbers 134 operate to absorb road shock forces so as to minimize user discomfort.

However, when the drive wheels 133 are subjected to lateral forces, because no mechanism is provided for limiting lateral movement of the suspension arms 131, the pivot axles 130 are easily twisted and deformed such that the shock-absorbing effect is affected undesirably.

SUMMARY OF THE INVENTION

Therefore, the object of the present invention is to provide a wheelchair that is capable of overcoming the aforesaid drawback associated with the prior art.

Accordingly, a wheelchair of the present invention comprises a chair frame, a pair of suspension arms, a pair of clutches, a pair of drive wheels, a pair of shock absorbers, and a pair of limiting units.

The chair frame includes a pair of lateral frame parts that extend in a first direction and that are spaced apart from each other in a second direction transverse to the first direction.

Each of the suspension arms extends in the first direction, and is connected pivotally to the chair frame adjacent to a respective one of the lateral frame parts such that the suspension arms are pivotable relative to the chair frame about a common pivot axis that extends in the second direction.

Each of the clutches is mounted on a respective one of the suspension arms.

Each of the drive wheels is coupled to a respective one of the clutches.

Each of the shock absorbers is mounted between a respective one of the lateral frame parts and a respective one of the suspension arms, and is capable of absorbing road shock forces.

Each of the limiting units includes a mounting seat mounted on a respective one of the lateral frame parts and formed with a guide slot unit therethrough, and a connecting component that extends through the guide slot unit and that mounts movably a respective one of the suspension arms on the mounting seat. Pivoting movement of the suspension arms about the pivot axis results in movement of the connecting components of the limiting units along the guide slot units in the mounting seats.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
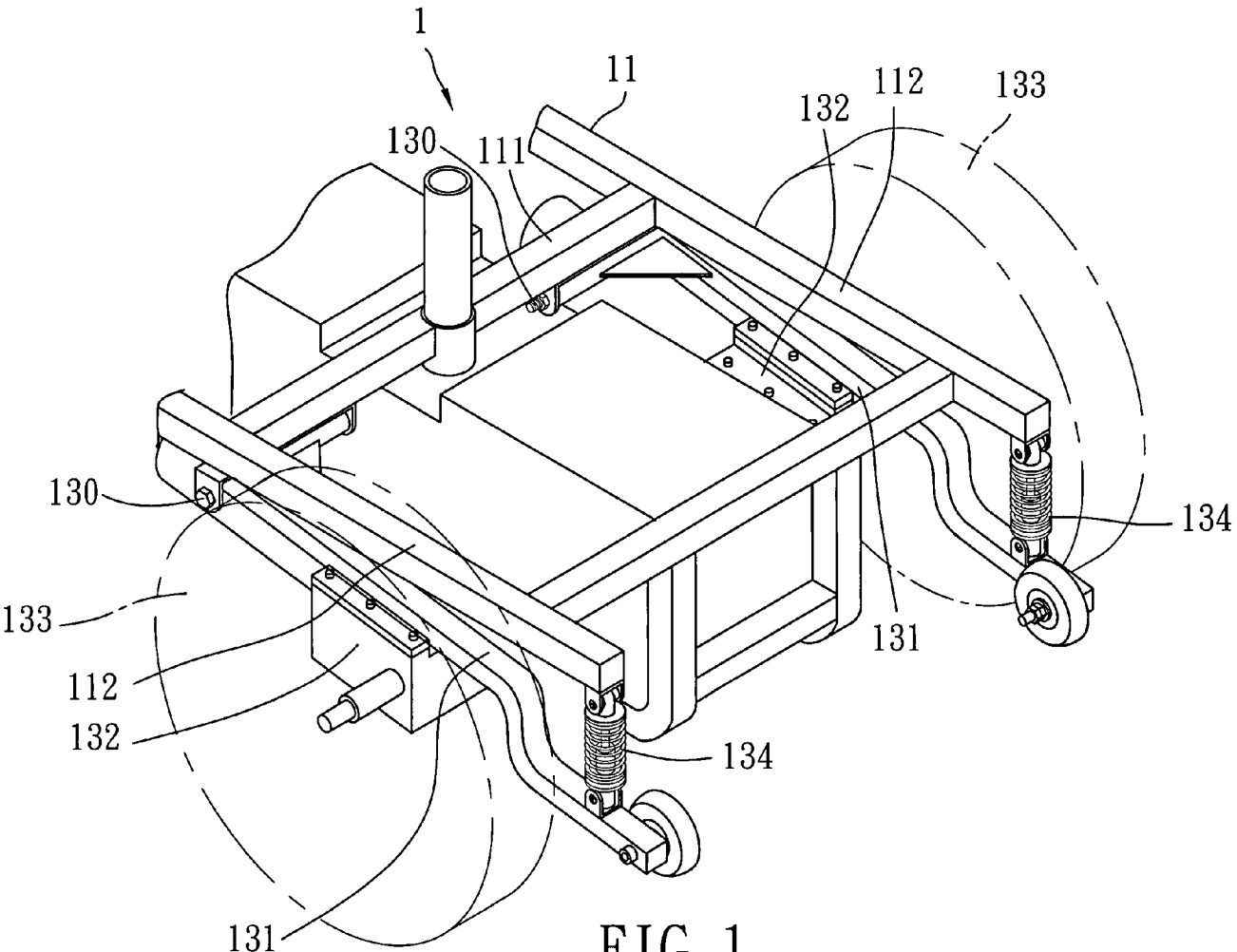
FIG. 1 PRIOR ART
FIG. 1 is a fragmentary perspective view of a conventional power wheelchair.
Figure 2:
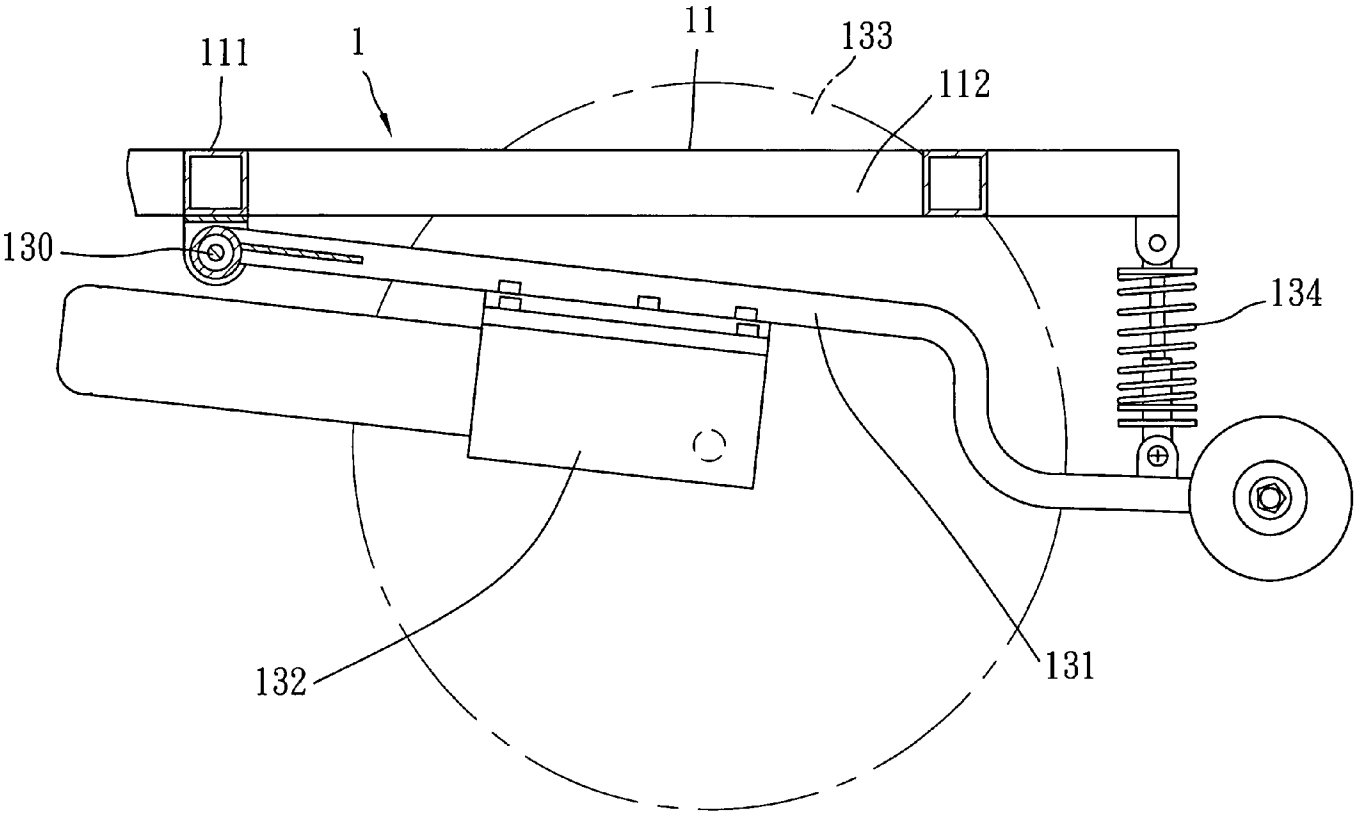
FIG. 2 PRIOR ART
FIG. 2 is a fragmentary schematic partly sectional view of the conventional power wheelchair.
Figure 3:
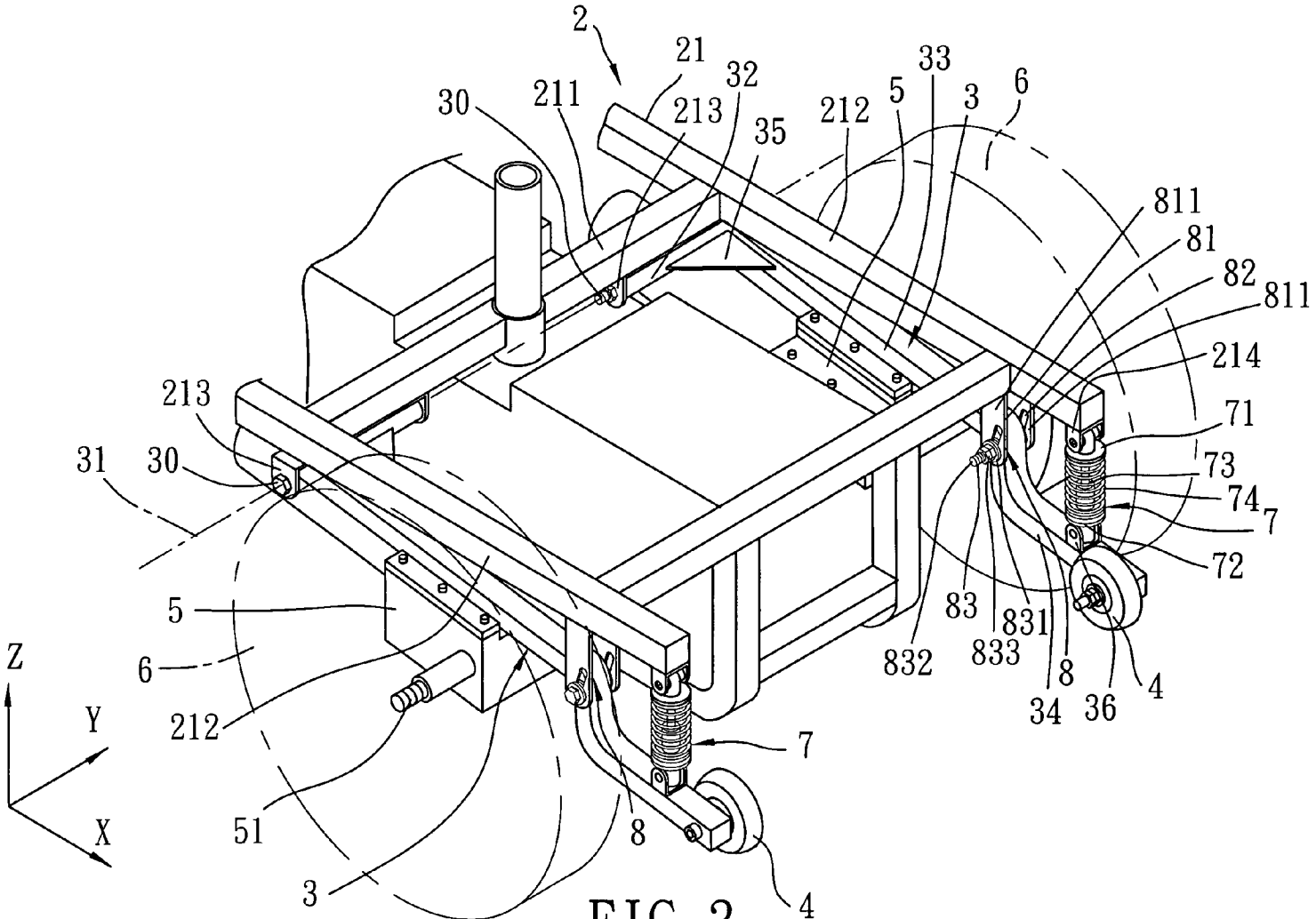
FIG. 3 is a fragmentary assembled perspective view of the preferred embodiment of a wheelchair according to the present invention.
Figure 4:
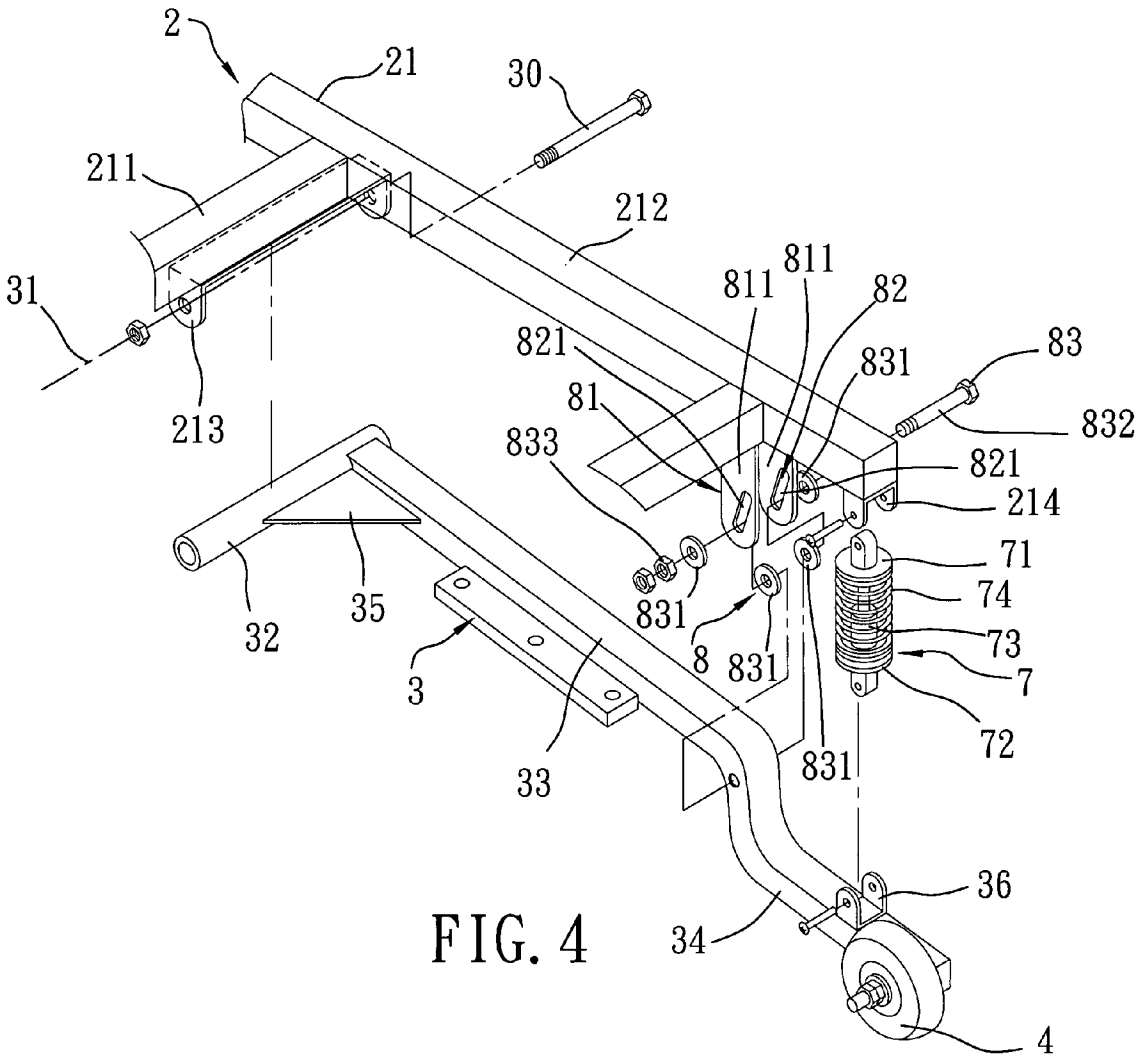
FIG. 4 is a fragmentary exploded perspective view of the preferred embodiment.
Figure 5:
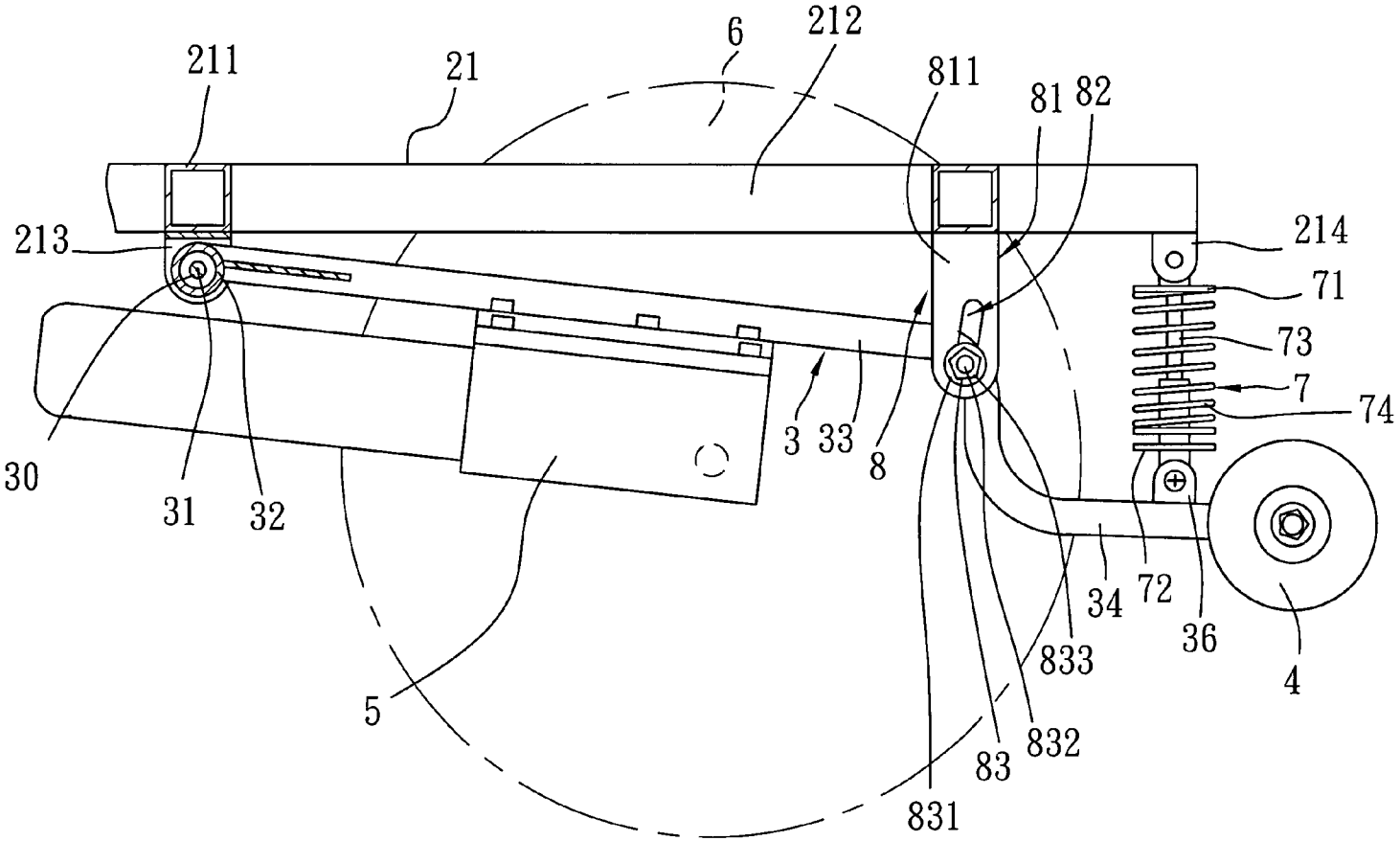
FIG. 5 is a fragmentary schematic partly sectional view of the preferred embodiment.

Referring to FIGS. 3, 4 and 5, the preferred embodiment of a wheelchair 2 according to the present invention is shown to be embodied in a power wheelchair that includes a chair frame 21, a pair of suspension arms 3, a pair of clutches 5, a pair of drive wheels 6, a pair of shock absorbers 7, and a pair of limiting units 8.

The chair frame 21 includes an intermediate frame part 211 and a pair of lateral frame parts 212 fixed to opposite ends of the intermediate frame part 211, respectively. The lateral frame parts 212 extend in a first direction (X), and are spaced apart from each other in a second direction (Y) transverse to the first direction (X). The intermediate frame part 211 extends in the second direction (Y), and has a pair of pivot seats 213 fixed to a bottom side thereof adjacent to the lateral frame parts 212, respectively. Each of the lateral frame parts 212 has a distal rear end mounted with a pivot coupler 214 on a bottom side thereof. Since the feature of the present invention does not reside in the specific construction of the chair frame 21, further details of the same are omitted herein for the sake of brevity.

Each of the suspension arms 3 extends in the first direction (X), and is connected pivotally to the chair frame 21 adjacent to a respective one of the lateral frame parts 212. In particular, each of the suspension arms 3 is connected pivotally to a respective one of the pivot seats 213 through a respective pivot axle 30 such that the suspension arms 3 are pivotable relative to the chair frame 21 about a common pivot axis 31 that extends in the second direction (Y). Each of the suspension arms 3 includes a pivot end section 32 that is disposed below the intermediate frame part 211, that extends in the second direction (Y), and that is connected pivotally to the respective pivot seat 213 by the respective pivot axle 30, a middle arm section 33 that extends downwardly and inclinedly in the first direction (X) from the pivot end section 32, and that is disposed below the respective lateral frame part 212, and a distal end section 34 that extends downwardly and inclinedly in the first direction (X) from the middle arm section 33, and that is disposed below the pivot coupler 214 on the respective lateral frame part 212. In this embodiment, each of the suspension arms 3 further includes a reinforcing plate 35 connected to the pivot end section 32 and the middle arm section 33 at a junction of the same. In addition, each of the suspension arms 3 further has a pivot coupler 36 mounted on a top side of the distal end section 34.

Each of the clutches 5 is mounted on the middle arm section 33 of a respective one of the suspension arms 3, and is provided with a coupling shaft 51. Since the clutches 5 are conventional in construction, further details of the same are omitted herein for the sake of brevity.

Each of the drive wheels 6 is coupled to the coupling shaft 51 of a respective one of the clutches 5, and can be driven rotatably for moving the wheelchair 2 on a surface.

Preferably, the wheelchair 2 further comprises a pair of rear wheels 4 that are mounted rotatably and respectively on the distal end sections 34 of the suspension arms 3 and that cooperate with the drive wheels 6 to enable the wheelchair 2 to climb up and down a stairway.

Each of the shock absorbers 7 is mounted between a respective one of the lateral frame parts 212 and a respective one of the suspension arms 3, and is capable of absorbing road shock forces in a third direction (Z) transverse to the first and second directions (X, Y). In this embodiment, each of the shock absorbers 7 includes a first coupling portion 71 connected pivotally to the pivot coupler 214 on the respective one of the lateral frame parts 212, a second coupling portion 72 connected pivotally to the pivot coupler 36 on the respective one of the suspension arms 3, a shock-absorbing cylinder 73 (such as a hydraulic cylinder) connected between the first and second coupling portions 71, 72, and a compression spring 74 sleeved on the cylinder 73 and having opposite ends that abut against the first and second coupling portions 71, 72, respectively. Since the shock absorbers 7 are well known in the art, further details of the same will not be provided herein for the sake of brevity.

Aside from limiting pivoting movement of the suspension arms 3 about the pivot axis 31, the limiting units 8 further restrict movement of the suspension arms 3 in the second direction (Y). Each of the limiting units 8 includes a mounting seat 81 mounted on the bottom side of a respective one of the lateral frame parts 212 and formed with a guide slot unit 82 therethrough, and a connecting component 83 that extends through the guide slot unit 82 and that mounts movably a respective one of the suspension arms 3 on the mounting seat 81. Pivoting movement of the suspension arms 3 about the pivot axis 31 results in movement of the connecting components 83 of the limiting units 8 along the guide slot units 82 in the mounting seats 81. In this embodiment, the mounting seat 81 of each of the limiting units 8 includes a pair of mounting plates 811 that have the middle arm section 33 of the respective one of the suspension arms 3 disposed therebetween. The guide slot unit 82 includes a pair of guide slots 821 formed through the mounting plates 811, respectively. Each of the guide slots 821 has a curvature center coincident with the pivot axis 31. The connecting component 83 of each of the limiting units 8 includes two pairs of washers 831 disposed on opposite sides of the mounting plates 811, a headed bolt 832 that passes through the washers 831, the guide slots 821 in the mounting plates 811, and the middle arm section 33 of the respective suspension arm 3, and a nut 833 that threadedly engages the headed bolt 832. It is noted that the actual number of the washers 831 is not limited to four, and may vary depending on actual requirements. Moreover, in other embodiments of this invention, the mounting seat 81 may have an integral configuration that includes one or two of the mounting plates 811.

In use, when the drive wheels 6 of the wheelchair 2 of this invention moves on an uneven road, because the drive wheels 6 are connected to the suspension arms 3 through the clutches 5, the suspension arms 3 are able to pivot accordingly about the pivot axis 31, and the shock absorbers 7 operate to absorb road shock forces. Moreover, when the drive wheels 6 are subjected to lateral forces, in view of the inclusion of the limiting units 8, only a small part of the lateral forces will be transmitted to the pivot axles 30, thereby avoiding undesired twisting and deformation of the pivot axles 30 to result in better shock-absorbing effects as compared to the conventional power wheelchair 1 described hereinabove.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A wheelchair comprising:

a chair frame including a pair of lateral frame parts that extend in a first direction and that are spaced apart from each other in a second direction transverse to the first direction;

a pair of suspension arms, each of which extends in the first direction and is connected pivotally to said chair frame adjacent to a respective one of said lateral frame parts such that said suspension arms are pivotable relative to said chair frame about a common pivot axis that extends in the second direction;

a pair of clutches, each of which is mounted on a respective one of said suspension arms;

a pair of drive wheels, each of which is coupled to a respective one of said clutches;

a pair of shock absorbers, each of which is mounted between a respective one of said lateral frame parts and a respective one of said suspension arms and is capable of absorbing road shock forces; and a pair of limiting units, each of which includes a mounting seat mounted on a respective one of said lateral frame parts and formed with a guide slot unit therethrough, and a connecting component that extends through said guide slot unit and that mounts movably a respective one of said suspension arms on said mounting seat, wherein pivoting movement of said suspension arms about the pivot axis results in movement of said connecting components of said limiting units along said guide slot units in said mounting seats.

2. The wheelchair as claimed in claim 1, wherein said mounting seat of each of said limiting units includes a mounting plate, and said guide slot unit includes a guide slot formed through said mounting plate.

3. The wheelchair as claimed in claim 2, wherein said guide slot has a curvature center coincident with the pivot axis.

4. The wheelchair as claimed in claim 2, wherein said connecting component of each of said limiting units includes a headed bolt and a nut that threadedly engages said headed bolt.

5. The wheelchair as claimed in claim 1, wherein said mounting seat of each of said limiting units includes a pair of mounting plates that have the respective one of said suspension arms disposed therebetween, and said guide slot unit includes a pair of guide slots formed through said mounting plates, respectively.

6. The wheelchair as claimed in claim 5, wherein each of said guide slots has a curvature center coincident with the pivot axis.

7. The wheelchair as claimed in claim 5, wherein said connecting component of each of said limiting units includes a headed bolt and a nut that threadedly engages said headed bolt.

8. The wheelchair as claimed in claim 1, wherein each of said suspension arms includes:

a pivot end section connected pivotally to said chair frame;

a middle arm section extending in the first direction from said pivot end section and mounted movably on said mounting seat of the respective one of said limiting units; and a distal end section extending in the first direction from said middle arm section and connected to the respective one of said shock absorbers.

9. The wheelchair as claimed in claim 8, wherein said pivot end section of each of said suspension arms extends in the second direction, each of said suspension arms further including a reinforcing plate connected to said pivot end section and said middle arm section.

10. The wheelchair as claimed in claim 8, further comprising a pair of rear wheels, each of which is mounted rotatably on said distal end section of a respective one of said suspension arms.

11. The wheelchair as claimed in claim 1, wherein each of said shock absorbers includes a first coupling portion connected pivotally to the respective one of said lateral frame parts, a second coupling portion connected pivotally to the respective one of said suspension arms, a shock-absorbing cylinder connected between said first and second coupling portions, and a spring sleeved on said cylinder and having opposite ends that abut against said first and second coupling portions, respectively.

* * * * *